US006032837A

United States Patent [19]

Uchikoshi

[11] Patent Number: 6,032,837

[45] Date of Patent: Mar. 7, 2000

[54] SHIRT PRESSING AND FINISHING MACHINE

[75] Inventor: Mitsuyuki Uchikoshi, Tokyo, Japan

[73] Assignee: San Kousha Co., Ltd., Tokyo, Japan

[21] Appl. No.: 09/296,924

[22] Filed: Apr. 22, 1999

[51] Int. Cl.[7] ..... A41H 5/00; D06F 71/34

[52] U.S. Cl. ..... 223/70; 223/68; 38/16; 38/66

[58] Field of Search ..... 223/68, 70, 66, 223/52, 73, 76; 38/16, 66

[56] References Cited

U.S. PATENT DOCUMENTS

| | | | |
|---|---|---|---|
| 1,847,573 | 3/1932 | Rupp | 38/66 |
| 3,593,440 | 7/1971 | Schlemon | 38/16 |
| 5,474,216 | 12/1995 | Harrod et al. | 223/70 |

FOREIGN PATENT DOCUMENTS

| | | | |
|---|---|---|---|
| 2231340A | 11/1990 | United Kingdom | 38/16 |

*Primary Examiner*—Bibhu Mohanty

*Attorney, Agent, or Firm*—Andrus, Sceales, Starke & Sawall

[57] ABSTRACT

The present invention relates to a shirt pressing and finishing machine in which body buck assemblies are arranged upright between a pair of front and rear pressplates. The pressplates are provided with a metallic pipe having a superior thermal conduction through which steam is passed. The metallic pipe is contacted with the rear surface of each of the pressplates and bent into a state in which the front surface of each of the pressplates is heated uniformly. The pressplates are formed by sticking metallic plates from each other, and the rear surface of each of the pressplates is formed by a metallic plate having a superior thermal conductivity.

8 Claims, 9 Drawing Sheets

SHIRT PRESSING AND FINISHING MACHINE

BACKGROUND OF THE INVENTION

1. Field of the Invention

This invention relates to a pressing machine for finishing shirt through its pressing, and more particularly, a pressing and finishing machine in which the shirt is pressed and finished by a pair of front and rear pressplates while the shirt is placed on a body buck assembly.

2. Description of the Related Art

As this kind of prior art finishing machine, there has been provided the invention described in the official gazette of U.S. Pat. No. 3,613,969, for example. The pressplate of this kind of finishing machine in the prior art was constructed such that the circumference of an iron plate is welded and formed into a closed container. Then, this prior art machine was operated such that steam was directly supplied into the pressplate, the pressplate was heated with heat of the steam and then the shirt was pressed and finished.

However, this pressplate is a major composing part of this kind of finishing machine. Accordingly, since the pressplate has a large rate in its price in respect to that of the finishing machine, it is desirable that the pressplate is formed such that it may be manufactured and machined in less-expensive manner.

In addition, the pressplate is changed into a pressure container in its function with heating steam. Accordingly, it is desirable that the pressplate is formed into such a shape as one in which it shows a high resistance against vibration or shock during its pressing operation as well as a high pressure-resistance and it can be used in a safe manner.

However, as described above, the prior art product was made such that the circumference of the iron plate was welded and its inner side was formed into a steam chamber. Accordingly, in the case of the prior art product, a high precision and complete welding operation was required to prevent steam from being leaked, resulting in that a tremendous amount of operation and labour was needed during manufacturing of the pressplate and correspondingly it could not be avoided that the price of the finishing machine by itself was increased.

Further, since the prior art product was operated such that steam was directly supplied into the pressplate, its long time use showed a possibility that the steammight be leaked out at the welded location due to vibration or shock during its pressing operation. Thus, the prior art product showed a short term of durable year and had a certain problem in view of its safety characteristic.

This invention is provided in view of such prior art problems as described above.

Accordingly, a technical problem of the present invention consists in providing a shirt pressing and finishing machine which can be attained in less-expensive manner and is constructed such that a high anti-pressure characteristic, high durability and high safety can be attained even if the machine is used for a long period of time without showing any leakage of steam.

SUMMARY OF THE INVENTION

This invention is a shirt pressing and finishing machine in which a body buck assembly is raised upright between a pair of front and rear pressplates. In the present invention, the pressplates are formed by providing a metallic pipe of high thermal conduction. The metallic pipe is contacted with the rear surface of each of the pressplates and arranged to be bent into such a shape as one in which the front surface of the pressplate is heated uniformly. The pressplates are formed by adhering the two metallic plates and the rear surface of the pressplate is formed by the metallic plate showing a high thermal conductivity.

Accordingly, in the case of the present invention, it is not necessary to perform a precise welding operation for the pressplate, so that a troublesome operation for manufacturing the pressplate can be reduced more substantially than that of the prior art product and correspondingly it can be provided in a less-expensive manner.

The operation of "the state of uniform heating of the front surface of the pressplate" can be accomplished more practically by making a zig-zag formation of the metallic pipe as shown in FIGS. 2, 3 and 4 and arranging the metallic pipe in an eddy form as shown in FIG. 7.

In addition, the present invention may be applied by arranging a system in which the heated state can be made uniform by adjusting a contact area between the metallic pipe and the pressplate. More practically, the pipe of the flowing-in port for steam showing a high temperature state is arranged in a rough state and in turn the pipe of the side of flowing-out port for steam where its temperature is decreased is arranged in a close-relationship.

As metal showing a superior thermal conduction, either copper or aluminum, for example, can be applied. Since copper has a high thermal conductivity and is easily machined, it is preferable that the metallic pipe and the rear surface of the pressplate is formed by copper.

In the case of the present invention, it is preferable that the metallic pipe is arranged under a state in which the steam inlet port and the steam outlet port are closely installed from each other. In this case, since the inlet port showing a high temperature and the outlet port showing a low temperature are closely arranged from each other, the temperature at this location can be easily made uniform. In addition, also in this case, it is possible to make a uniform arrangement of the steam pipe passages.

As shown in FIGS. 8 and 9, it is preferable that each of the steam inlet and the steam outlet is arranged at the lower part of the pressplate and the steam raising passage ranging from the inlet to the upper part of the pressplate is always arranged to be directed upwardly and the steam descending passage ranging from the upper part of the pressplate to the outlet is always arranged to be directed downwardly.

In this case, the present invention has an advantage that accumulation of cooling water for steam in the metallic pipe can be prevented.

In addition, it is preferable in the present invention that the metallic pipe is flat in its shape. Because, in this case, the contact area between the metallic pipe and the rear surface of the pressplate can be increased and the pressplate can be made thin. More practically, there occurs a case in which its sectional surface is of an ellipse as shown in FIG. 1B, for example, or its sectional surface is of a parallel-piped shape as shown in FIG. 10. In the present invention, although it is preferable that the metallic pipe is directly welded to the rear surface of the pressplate, it is also preferable that the metallic pipe is fixed through a fixing fitting as shown in FIG. 11.

Additionally, both the metallic pipe and the metallic plate at the rear surface of the pressplate in the present invention are made of copper. Because, in this case, it is possible to prevent a bad influence caused by a difference in thermal expansion in these two members.

Further, in the present invention, the front and rear surfaces of the body buck assembly are made flat and they are widened as their relative gap is lowered and they are formed into a slant surface. In this case, when a shirt is dressed on the body buck assembly, the shirt is well fitted to the body buck assembly without being slackened. Accordingly, in the case of the present invention in which the body buck assembly is provided, it is possible to make a clean finish of the shirt. Further, it is preferable that a gradient of each of the front surface and the rear surface of the body buck assembly is selected to show the same value from each other. Because, in this case, the body buck assembly can be pressed in well-balanced state.

In addition, it is preferable in the present invention that the body buck assembly is installed at each of the front surface and the rear surface of the device, respectively, and the body buck assemblies are formed to be arranged alternatively at the forward position and the rearward position of the device. In this case, the pressing work and dressing of the shirt on the body buck assembly or removing the pressed shirt from the body buck assembly can be carried out efficiently in a concurrent manner.

DESCRIPTION OF THE PREFERRED EMBODIMENTS

Figure 1A:
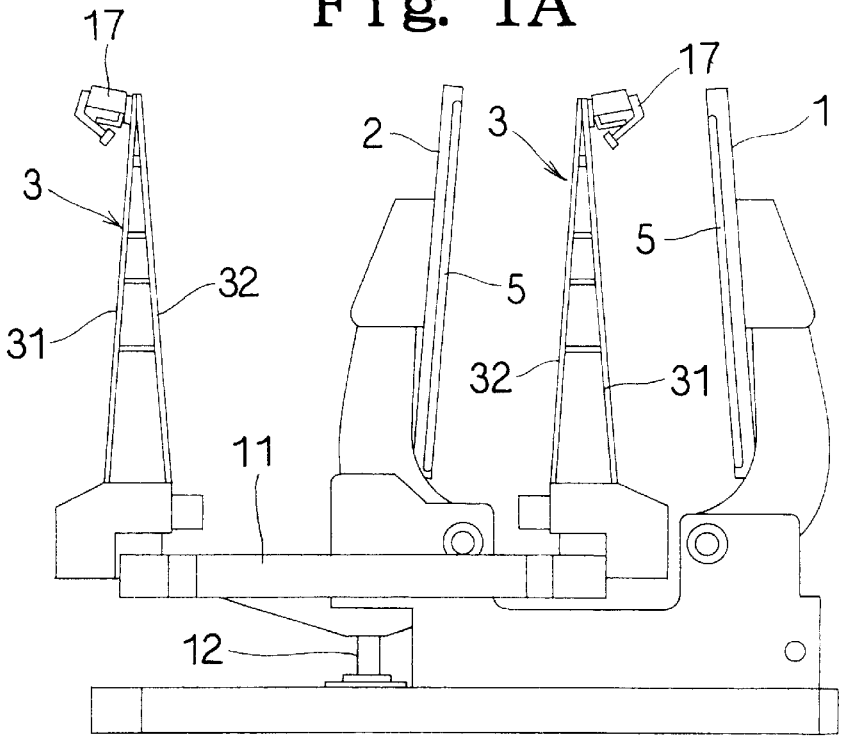
FIG. 1A is a side elevational view for showing a finishing machine of the present invention.

Referring now to the accompanying drawings, one preferred embodiment of the present invention will be described as follows.

In FIG. 1 or the like, reference numeral 1 denotes a front pressplate and reference numeral 2 denotes a rear pressplate. The finishing machine of the present invention is constructed such that body buck assemblies 3 are raised upright between a pair of front pressplate 1 and rear pressplate 2.

The aforesaid pressplates 1 and 2 are formed such that there is provided a metallic pipe 4 of superior thermal conduction through which steam is flowed. This metallic pipe 4 is made of copper in this preferred embodiment, wherein its sectional surface is formed to be flat in its ellipse shape.

The metallic pipe 4 is contacted with the rear surface of the pressplate 5 and arranged to be bent in a state in which the front surface of the pressplate 5 is heated uniformly. More practically, one metallic pipe 4 is bent in a zig-zag form to perform a uniform heating of an entire surface of the pressplate 5 and then welded to the rear surface of the pressplate 5. In addition, as shown in FIGS. 3 and 4, an inlet 6 and an outlet 7 of the metallic pipe 4 for steam are arranged near from each other.

Figure 1B:
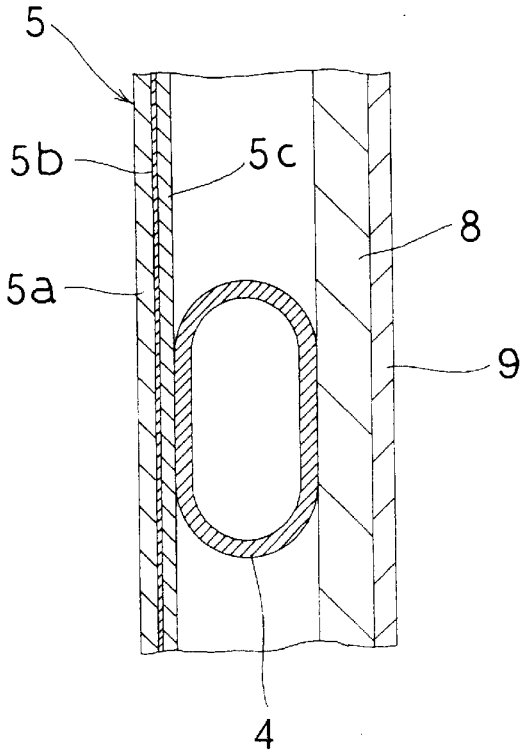
FIG.1B is a sectional view for showing a substantial part of a pressplate.

As shown in FIG. 1B, the pressplate 5 in the preferred embodiment is formed such that a copper plate acting as a metallic plate 5*c* is heat pressed against an iron plate 5*a* through a soldering foil 5*b*. Accordingly, the pressplate 5 is formed to have both characteristics of a hardness of the iron plate 5*a* and a thermal conduction of the copper plate.

Figure 2:
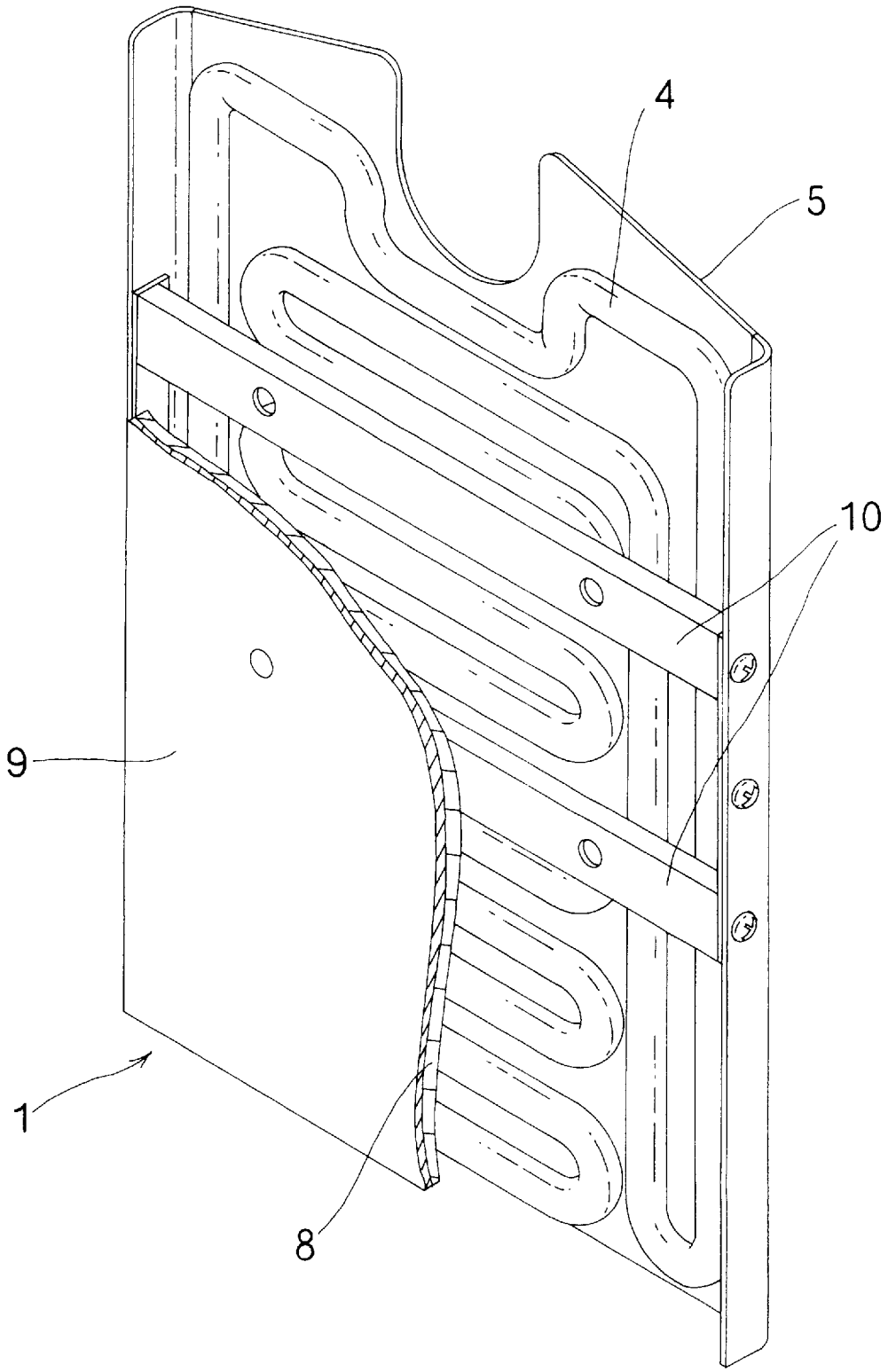
FIG. 2 is a perspective view for showing a substantial part with a part of a front pressplate being broken away.

The rear surface of the pressplate 5 is covered by a rear surface cover 9 through a thermal insulating material 8. Reference numeral 10 (refer to FIG. 2 or the like) denotes reinforcing beams applied to both side surfaces of the pressplate 5.

Each of the aforesaid body buck assemblies 3 in this preferred embodiment is arranged at both ends of a horizontal supporting lever 11 as shown in FIG. 1. The supporting lever 11 is formed such that it can be freely reversed around its center. The body buck assemblies 3 are formed to be arranged alternatively across the forward or rearward position of the device through an operation of the supporting lever 11.

Accordingly, when one body buck assembly 3 in the present invention is arranged between the pressplates 1 and 2, a shirt 13 (refer to FIG. 5) is pressed. Then, an operator dresses a new shirt 13 onto the other body buck assembly 3. Thus, pressing operations can be carried out efficiently in concurrent relation from each other in the finishing machine of the present invention.

Figure 6:
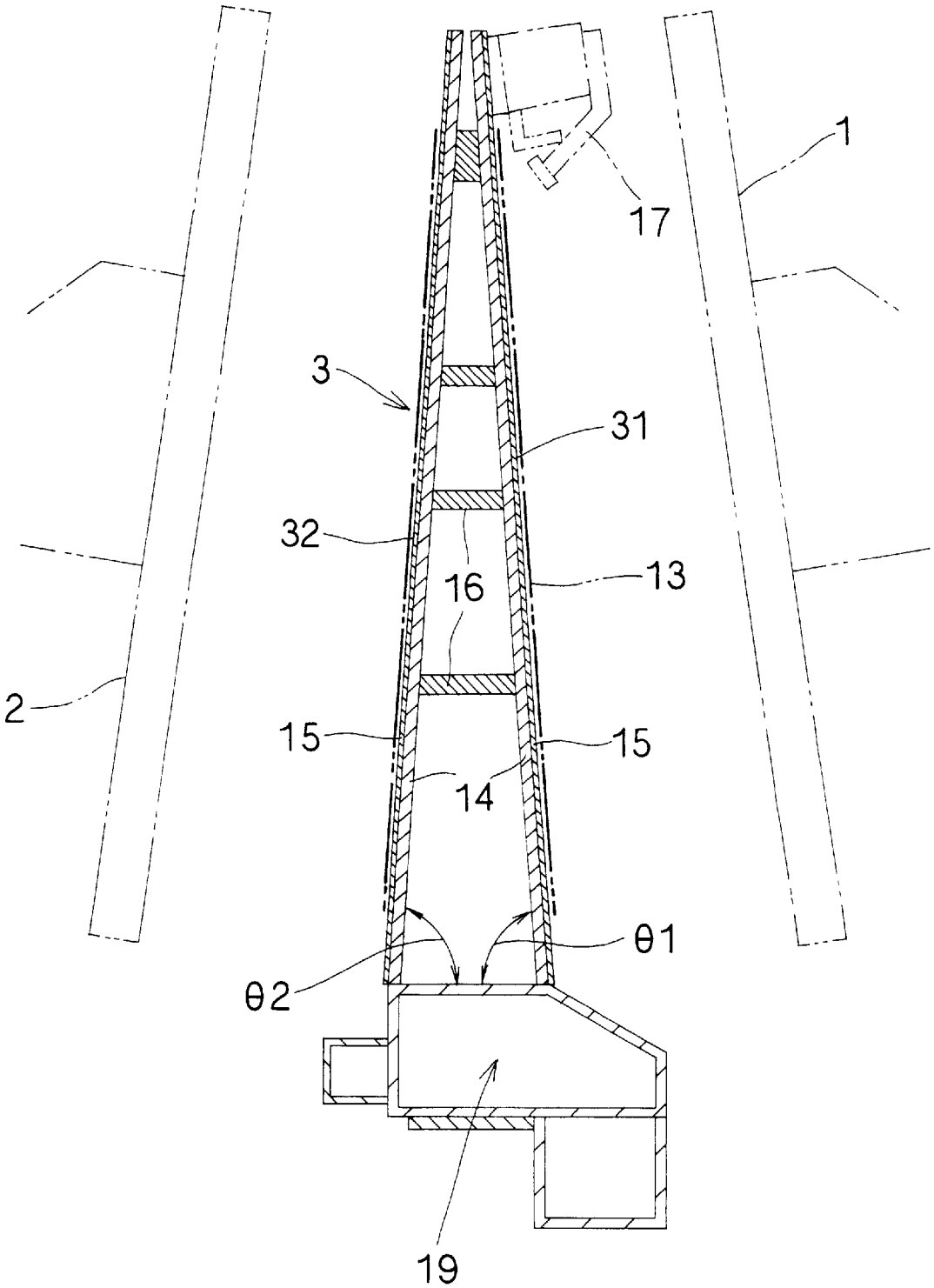
FIG. 6 is a sectional view for showing a substantial part taken along line VI—VI of FIG. 5.

A front surface 31 and a rear surface 32 of the body buck assembly 3 are formed in flat shape. Spacing between the front surface 31 and the rear surface 32 is made wide as they approach downwardly and they are formed in a slant surface. As shown in FIG. 6, the front surface 31 and the rear surface 32 of the body buck assembly 3 are made such that the surfaces of the base plates 14 are covered by aeration pads 15. Reference numeral 16 denotes separators for keeping a spacing between the front surface 31 and the rear surface 32. Each of gradients at the front surface 31 and the rear surface 32 is set such that each of $\theta 1$ and $\theta 2$ is selected as 85°, respectively.

Figure 5:
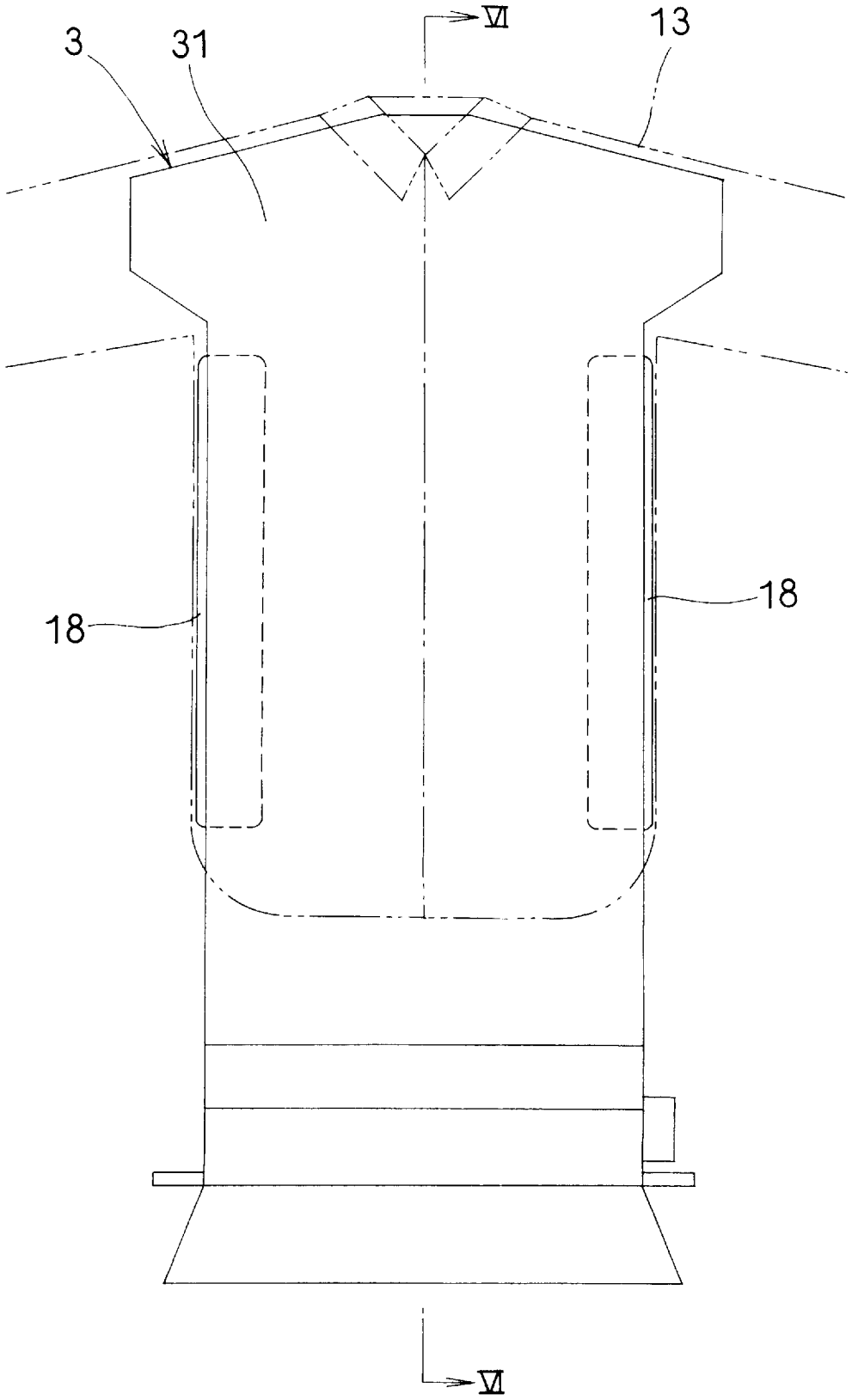
FIG. 5 is a front elevational view for showing a substantial part to indicate a body buck assembly.

Reference numeral 17 (refer to FIGS. 1A and 6) denotes a pressing member for pressing a collar of the shirt 13. As shown in FIG. 5, the body buck assembly 3 is provided with, at both sides, expansion bags 18 for tightening both sides of the shirt 13. In addition, as shown in FIG. 6, the body buck assembly 3 is provided with a hot air supplying passage 19 at its lower part.

Figure 3A:
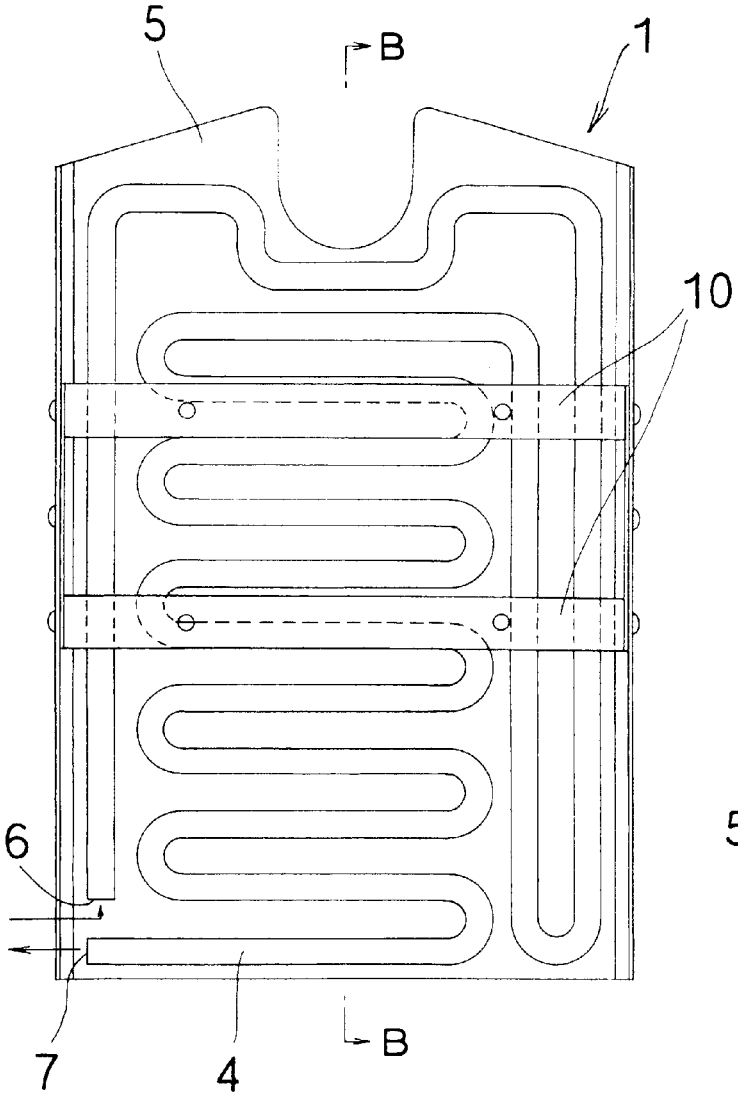
FIG. 3A is a front elevational view for showing a substantial part of a front pressplate.
Figure 3B:
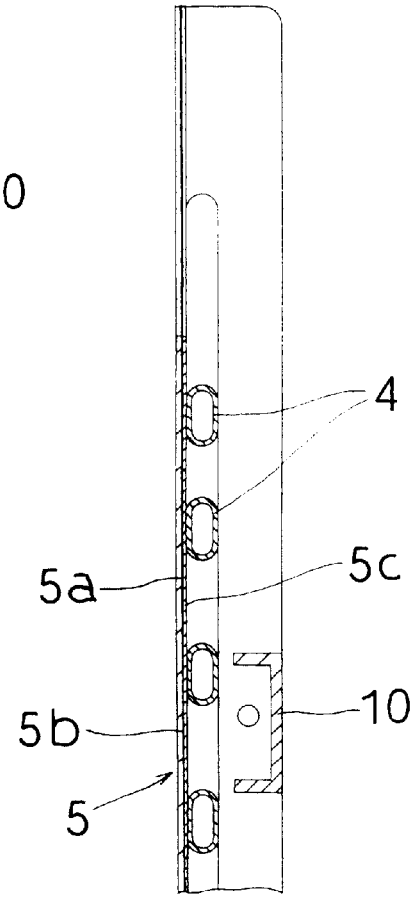
FIG. 3B is an enlarged sectional view for showing a substantial part taken along line B—B of FIG. 3A.
Figure 4:
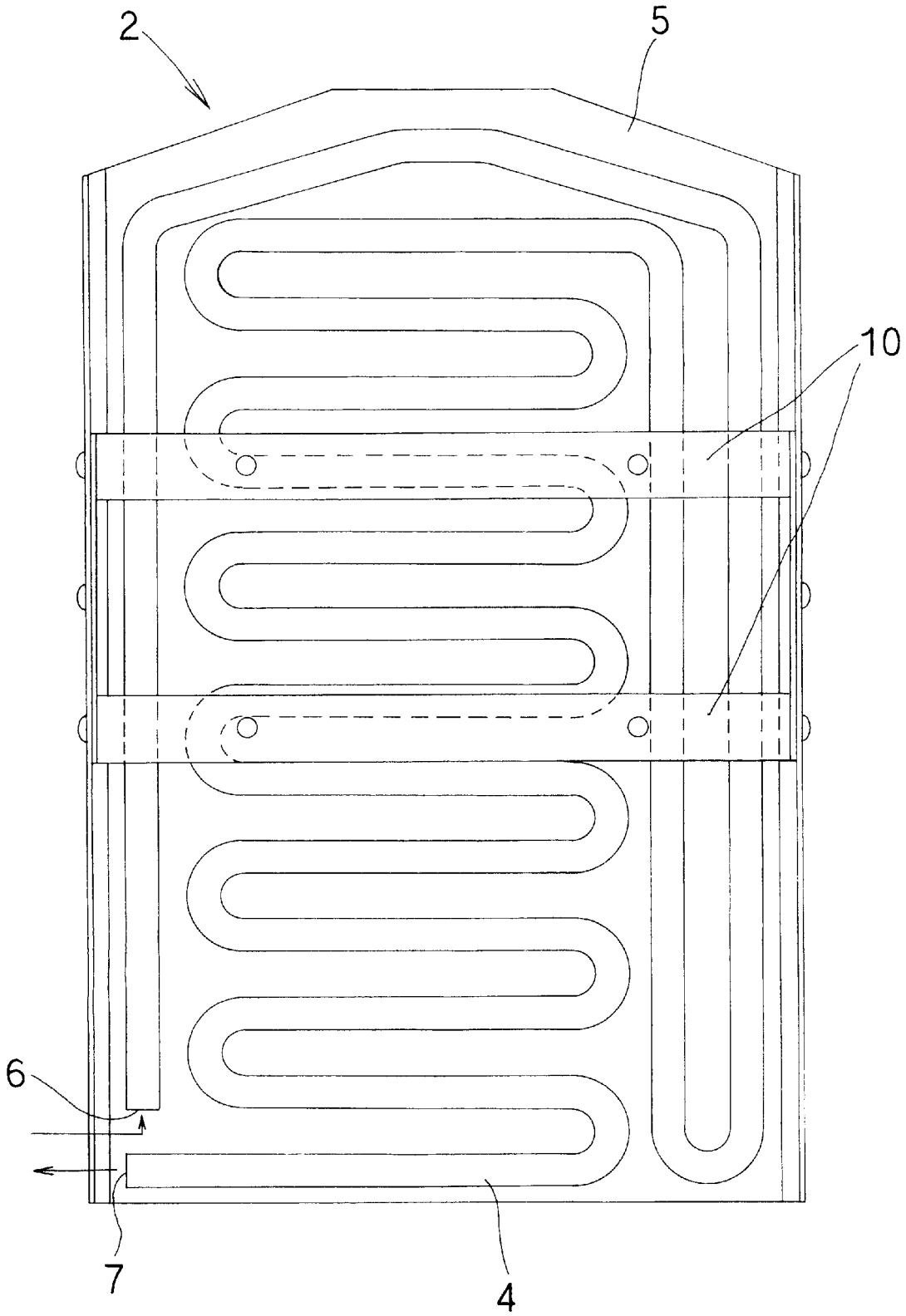
FIG. 4 is a front elevational view for showing a substantial part of a rear pressplate.

In the case of the present invention, when heating steam is supplied from an external section to the metallic pipe 4 as shown in FIGS. 3A and 4, heat of the steam is transmitted to the pressplate 5 while it is flowing in the metallic pipe 4 so as to heat the pressplate 5. In this case, since the metallic pipe 4 and the rear surface of the pressplate 5 are made of metal having a superior thermal conductivity, heat of the steam is transmitted to the pressplate 5 smoothly and efficiently.

In addition, the body buck assembly 3 in the present invention is formed such that the spacing between the front surface 31 and the rear surface 32 is widened as they approach downwardly and they are formed in a slant surface shape, so that when the shirt 13 is dressed onto the body buck assembly, the front, rear and bottom of the body of the shirt 13 are fitted onto the body buck assembly 3.

Figure 7:
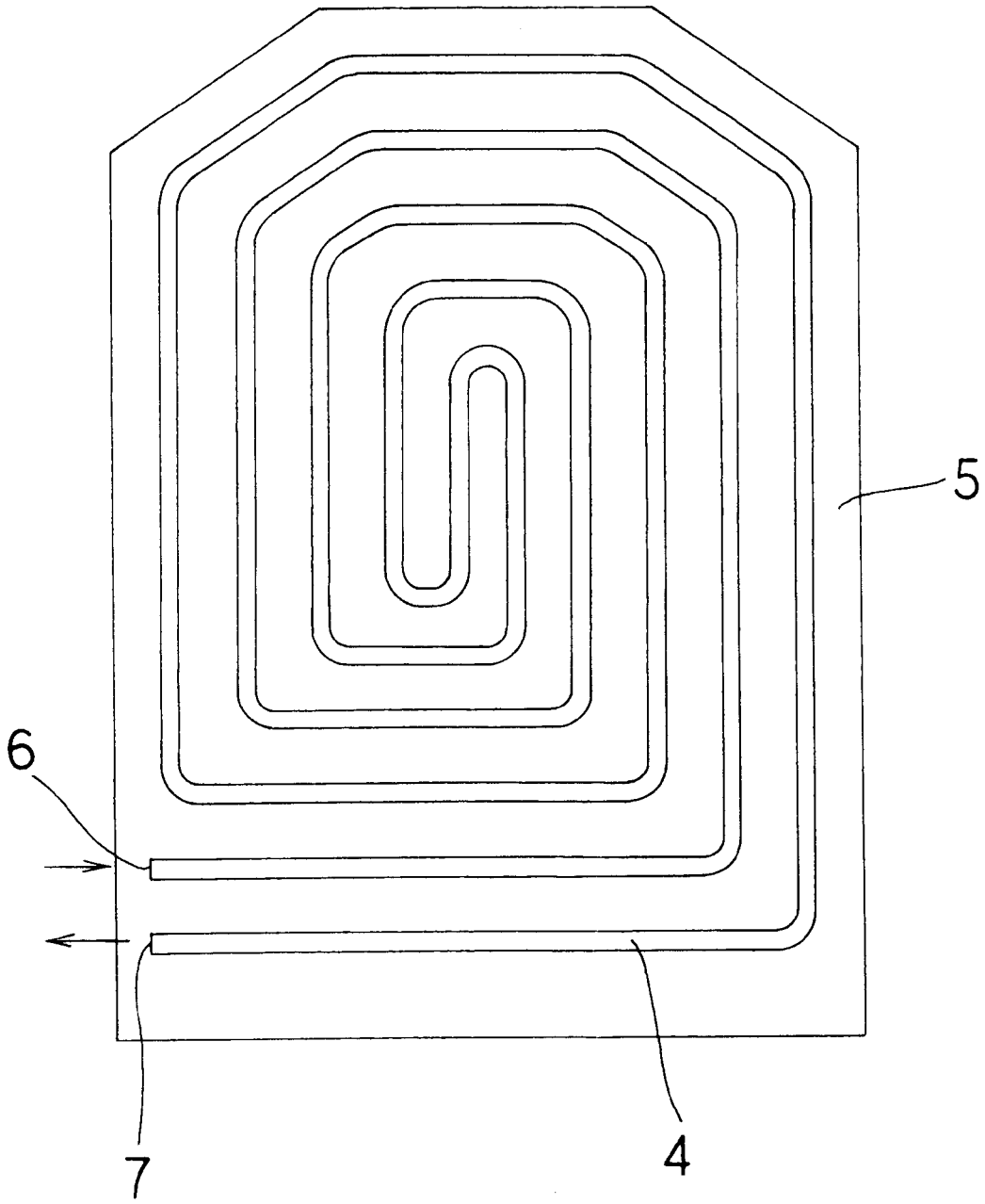
FIG. 7 is a front elevational view for showing a substantial part to indicate another example of piping of a metallic pipe.
Figure 8:
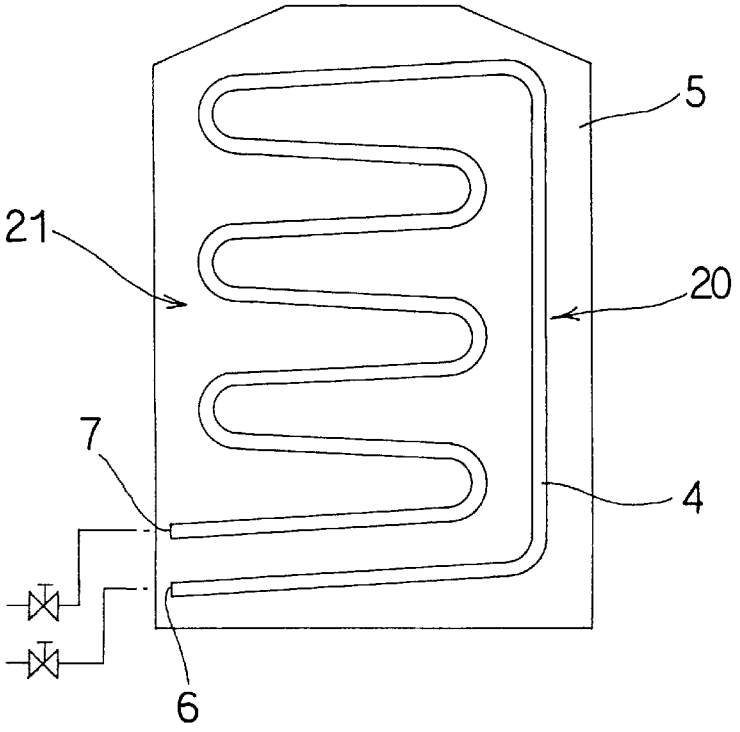
FIG. 8 is a front elevational view for showing a substantial part to indicate a still further example of piping of a metallic pipe.
Figure 9:
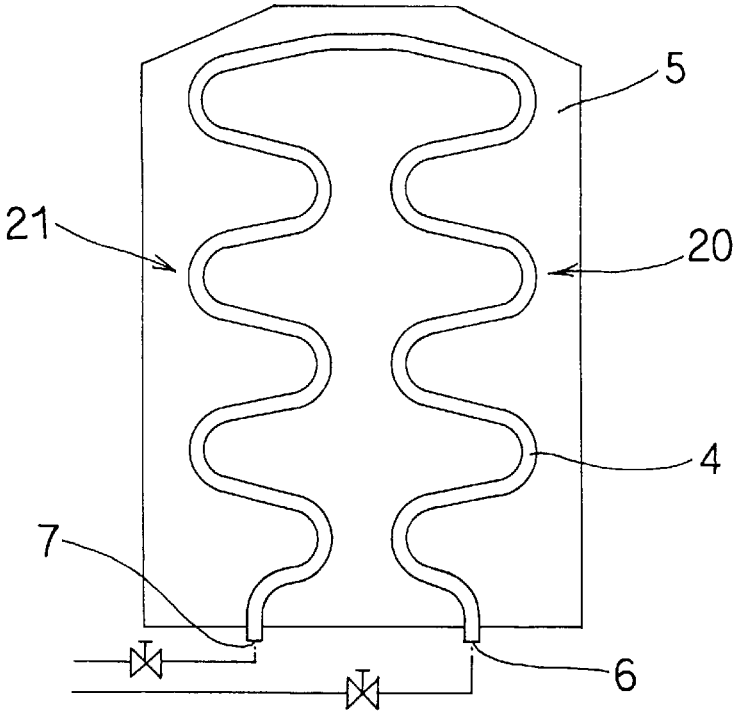
FIG. 9 is a front elevational view for showing a substantial part to indicate a yet still further example of piping of a metallic pipe.

Thus, in the case of the present invention, it may also be applicable that the aforesaid metallic pipe 4 is arranged in an eddy form as shown in FIG. 7. As shown in FIGS. 8 and 9, it is also applicable that each of the steam inlet port 6 and the steam outlet port 7 is arranged at the lower part of the pressplate 5 and at the same time an ascending passage 20 for the steam ranging from the inlet port 6 to the upper part of the pressplate 5 is always arranged to be directed upwardly and a descending passage 21 for the steam ranging from the upper part of the pressplate 5 to the outlet port 7 is always arranged to be directed downwardly.

Figure 10:
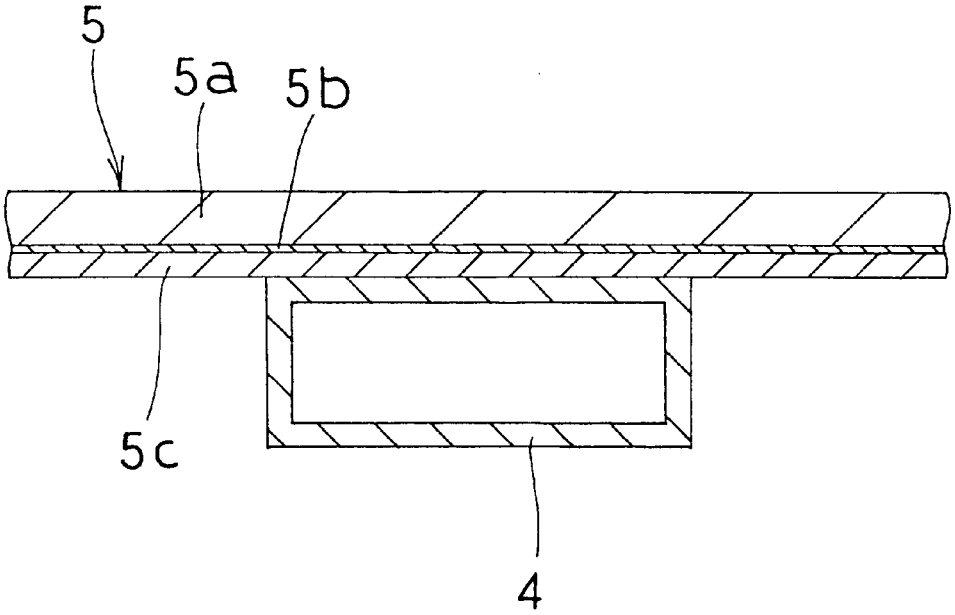
FIG. 10 is a sectional view for showing a substantial part to indicate another sectional shape of a metallic pipe.
Figure 11:
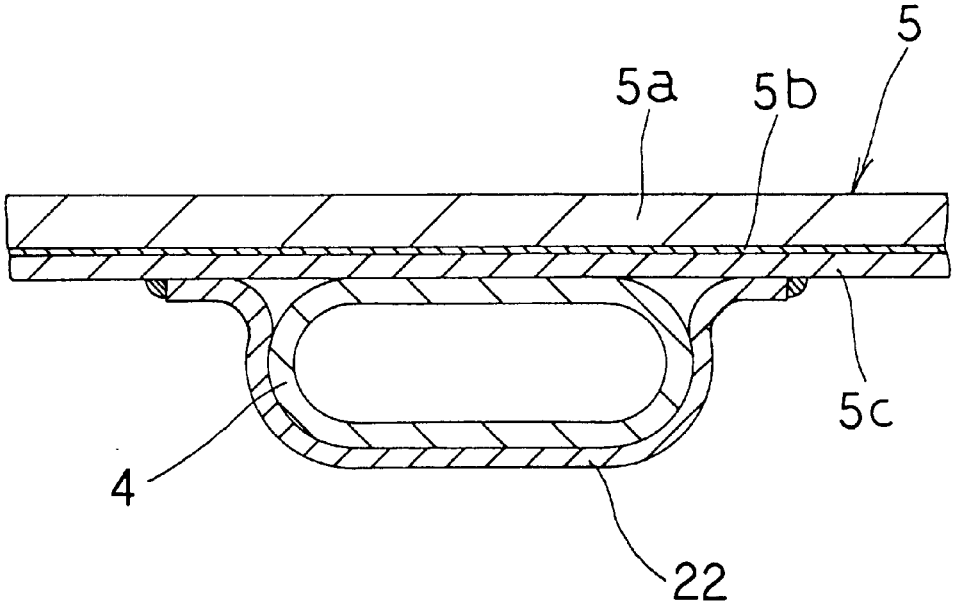
FIG. 11 is a sectional view for showing a substantial part to indicate another fixing example of a metallic pipe.

In addition, as shown in FIG. 10, the shape of the sectional surface of the metallic pipe 4 may be of a parallel-piped shape. Further, as shown in FIG. 11, the metallic pipe 4 is also applicable if a metallic pipe is fixed through the fixing fitting 22 and this is not limited to one in which a metallic pipe is directly welded to the pressplate 5.

What is claimed is:

1. A shirt pressing and finishing machine in which body buck assemblies are arranged upright between a pair of front and rear pressplates, wherein said pressplates are provided with a metallic pipe having a superior thermal conduction through which steam is passed, the metallic pipe is contacted with the rear surface of each of the pressplates and bent into a state in which the front surface of each of the pressplates is heated uniformly, said pressplates are formed by sticking metallic plates to each other, and the rear surface of each of the pressplates is formed by a metallic plate having a superior thermal conductivity.

2. A shirt pressing and finishing machine according to claim 1, wherein the metallic pipe is arranged under a state in which a steam inlet port and a steam outlet port are approached near each other.

3. A shirt pressing and finishing machine according to claim 2, wherein each of the steam inlet port and the steam outlet port of the metallic pipe is arranged at the lower part of the pressplate, a steam ascending passage ranging from the inlet port to the upper part of the pressplate is always arranged in an upward direction and a steam descending passage ranging from the upper part of the pressplate to the outlet port is always arranged in a downward direction.

4. A shirt pressing and finishing machine according to claim 1, wherein both the metallic pipe and the metallic plate at the rear surface of the pressplate are made of copper.

5. A shirt pressing and finishing machine according to claim 4, wherein the metallic pipe is in a flat shape.

6. A shirt pressing and finishing machine according to claim 1, wherein the front surface and the rear surface of the body buck assembly are formed in flat surface and their spacing is widened as they approach downwardly and formed into a slant surface.

7. A shirt pressing and finishing machine according to claim 6, wherein a gradient of each of the front surface and the rear surface of the body buck assembly is set to be same in relation to each other.

8. A shirt pressing and finishing machine according to claim 1, wherein the body buck assemblies are arranged upright at both ends of a horizontal supporting lever while being contacted to each other at their backs and the supporting lever can be freely reversed around its axis.

* * * * *